US011482393B2

(12) United States Patent
Chen et al.

(10) Patent No.: US 11,482,393 B2
(45) Date of Patent: Oct. 25, 2022

(54) FUSE AND PRODUCTION METHOD THEREFOR

(71) Applicant: AEM COMPONENTS (SUZHOU) CO., LTD, Jiangsu (CN)

(72) Inventors: Xiqing Chen, Jiangsu (CN); Xiangming Li, Jiangsu (CN); Xiaobing Shan, Jiangsu (CN); Yonglin Yang, Jiangsu (CN)

(73) Assignee: AEM Components (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 17/286,426

(22) PCT Filed: Oct. 14, 2019

(86) PCT No.: PCT/CN2019/111005

§ 371 (c)(1),
(2) Date: Apr. 16, 2021

(87) PCT Pub. No.: WO2020/078313

PCT Pub. Date: Apr. 23, 2020

(65) Prior Publication Data

US 2021/0391137 A1 Dec. 16, 2021

(30) Foreign Application Priority Data

Oct. 19, 2018 (CN) ..... 201811221620.2

(51) Int. Cl.
*H01H 85/17* (2006.01)
*H01H 85/18* (2006.01)
*H01H 69/02* (2006.01)

(52) U.S. Cl.
CPC ..... *H01H 85/18* (2013.01); *H01H 69/02* (2013.01); *H01H 85/17* (2013.01)

(58) Field of Classification Search
CPC .... H01H 85/1755; H01H 85/18; H01H 85/38; H01H 2085/388; H01H 69/02; H01H 85/17
See application file for complete search history.

(56) References Cited

U.S. PATENT DOCUMENTS 4,506,310 A 3/1985 Schwarz
6,034,589 A * 3/2000 Montgomery ..... H01H 85/0411 337/296

(Continued)

FOREIGN PATENT DOCUMENTS

CN 102013368 A 4/2011
CN 205542673 U 8/2016

(Continued)

OTHER PUBLICATIONS

DE 1463002 A Translation. (Year: 1969).*

(Continued)

*Primary Examiner* — Jacob R Crum
(74) *Attorney, Agent, or Firm* — Knobbe, Martens, Olson & Bear, LLP

(57) ABSTRACT

A fuse and a production method therefor. The fuse includes upper and lower insulating layers provided with terminal electrodes, and a fuse element between the upper and lower insulating layers. The fuse further includes a functional layer provided between the fuse element and the insulating layers. The functional layer includes a substrate and an arc extinguishing material uniformly or substantially uniformly distributed in the substrate; the arc extinguishing material includes a sealed cavity; the substrate includes low temperature co-fired ceramic powder, aerosol silicon oxide, silicon oxide, inert resin, phosphoric acid, and phosphate ester polyester; the content of the arc extinguishing material is 1-50 wt %. The fuse overcomes the shortcomings of phenomena such as deformation, bending, and defects occurring (Continued)

to a fuse element caused by the shrinkage mismatch of the fuse element with a buffer layer and an arc extinguishing layer in a sintering process.

19 Claims, 5 Drawing Sheets

(56) References Cited

U.S. PATENT DOCUMENTS

2006/0066435 A1* 3/2006 Li ..... H01H 85/38 337/186
2010/0289612 A1* 11/2010 Chiu ..... H01H 85/0418 337/296
2015/0002258 A1* 1/2015 Yoshida ..... H01H 85/143 337/273
2015/0009007 A1* 1/2015 Enriquez ..... H01H 85/0411 337/290
2016/0217960 A1* 7/2016 Abad ..... H01H 85/143

FOREIGN PATENT DOCUMENTS

CN 105977115 A 9/2016
CN 106206201 A 12/2016
CN 109192635 A 1/2019
CN 208738169 U 4/2019
DE 1463002 A1 * 4/1969
DE 1463002 A1 * 4/1969

OTHER PUBLICATIONS

Kaufmann. Translation of DE 1463002 A1. (Year: 1969).*
Written Opinion for International Patent Application No. PCT/CN2019/111005, dated Jan. 16, 2020, in 5 pages.

* cited by examiner

FUSE AND PRODUCTION METHOD THEREFOR

CROSS REFERENCE TO RELATED APPLICATIONS

This application is the U.S. National Phase under 35 U.S.C. § 371 of International Application PCT/CN2019/111005, filed Oct. 14, 2019, which is hereby incorporated by reference herein in its entirety and which claims the benefit of priority to Chinese Patent Application No. 201811221620.2, filed Oct. 19, 2018.

FIELD OF TECHNOLOGY

The present disclosure relates to the field of electrical protection components, and in particular provides a production method for a fuse comprising a functional layer with multiple functions such as arc extinguishing and pressure relief, and a fuse produced by the method.

BACKGROUND

Fuse is widely used in overcurrent protection of various electronic components. The metal conductor is used as the fuse-element to be connected in series in the circuit, and when the circuit is abnormal and the current exceeds a specified value, the fuse-element of the fuse will automatically melt to break the circuit and protect the electrical appliances.

With the increase of the rated voltage in the application circuit, the fuse cannot withstand the high-voltage energy during the fusing process, and there are potential safety hazards such as broken, chipped, burned, and flying away from the circuit board, therefore, it is urgent to find a material or structure that can effectively improve the pressure resistance of the fuse.

The current technical solutions to improve this problem are mostly based on introducing grooves or cavities around the fused mass, or filling the grooves with porous slurry to achieve the effect of pressure relief or arc extinguishing. For example, CN2010101221215 discloses a fuse, which adopts an embedded-type circuit lamination method, wherein at least one pressure relief and heat gathering space is provided between two stacked substrates, and a fuse element penetrates through the pressure relief and heat gathering space, therefore this pressure relief and heat gathering space can gather a high temperature generated when current flows through the fuse element, and can release pressure generated when the fuse element is fused. In one aspect, the disadvantage of this method is that due to that the fuse element penetrates through the pressure relief and heat gathering space, at least one side is located in the groove, and the patent mentions that such a protective element will be sintered, however, a sintering process is a shrinking and densification process for the fuse element and a ceramic substrate; in another aspect, due to that at least one side of the fuse element is in the groove structure, it cannot shrink together with the substrate, which will easily lead to bend and deformation of the fuse element, which will cause the fusion consistency of the fuse element to deteriorate, and it is prone to non-linear fuse that affects the normal operation of the circuit; another disadvantage of this design is that the size of the groove after sintering becomes smaller due to the shrinkage of the ceramic substrate, and the size is difficult to control; in addition, the fusing process of the fuse element will have serious arcing phenomenon under high voltage conditions, especially under the condition that high voltage and high current will be generated when the circuit is short-circuited, and this situation put forward a high requirement to the fuse in view of a breaking capacity, although the design in this patent has a groove for pressure relief, there is no arc extinguishing material that can not strike out the arc, resulting in a strong discharge in the groove, and the unsafe phenomenon of incomplete fusing of the protection element, which causes the circuit board to burn.

CN2012102771048 discloses a fuse, which adopts a stamping groove on the ceramic substrate of an element, and the stamping groove is filled with porous ceramics slurry or pore-forming agent slurry of Low Temperature Co-fired Ceramic (LTCC), a fuse-element layer is stacked on the ceramic substrate filled with porous ceramics slurry or pore-forming agent slurry of LTCC, and the fuse-element is located right above the stamping groove filled with porous ceramics slurry or pore-forming agent slurry of LTCC; another ceramic substrate is stacked on the ceramic substrate having the fuse-element layer, wherein the stamping groove portions of two ceramic substrates are located on the same vertical plane, so that the fuse-element layer is located between the stamping groove portions which are filled with the porous ceramics slurry or the pore-forming agent slurry of LTCC, which can disperse an impact effect on a product, wherein the impact effect is caused by high-pressure heat flow generated when a fuse element acts. This method of dry molding needs to press the two ceramic substrates together in the later stage, and this pressing process will cause the pore-forming agent slurry and the fuse-element to be squeezed, which causes the fuse-element to deform; in another aspect, the porous ceramics or pore-forming agent introduced in this solution will discharge organic matter through low temperature co-firing to form a porous structure, while the existence of these pores will cause the fuse element to diffuse into the above-mentioned pores during the sintering process, which causes defects in the fuse element itself, and results in growth of the resistance of the fuse element and the power consumption in the line, and causes the fusion consistency to become worse, so that abnormal fusing would occur, which affects the normal operation of the circuit.

CN2009101263357 adopts a low-temperature integrated molding method to manufacture a current protective element comprising a substrate, a fuse element, a cavity, an anti-arc layer and a terminal electrode; in order to achieve a higher rated current capability, this invention adopts that the anti-arc layer is introduced above or below the fuse element, and the cavity is introduced above or below the arc layer or the fuse element; such structure will cause one side of the anti-arc layer or the fuse element to be on an unconstrained free shrinking surface during the low temperature forming process, which will cause deformation of the anti-arc layer or fuse element, and defects in the anti-arc layer or fuse element therefore; thereby the fusing and arc extinguishing characteristic of the fuse is affected, which makes the fuse be unable to withstand higher rated voltages and rated currents, therefore the fuse fails to safely break in the short circuit process, which causes the fuse to burst, blow up, side blowout and burn and other phenomena that endanger the safety of the circuit board.

CN2016107785327 discloses a fuse, which has an arc extinguishing layer around a fuse element, and a buffer layer on the periphery of the arc extinguishing layer and/or the periphery of the fuse element, and the buffer layer has an accommodating space or a porous structure. In the production process, slurry of the arc extinguishing layer is first coated around the fuse element, and then slurry of the buffer layer is printed on the periphery of the arc extinguishing layer and/or the periphery of the fuse element by screen printing; this structure has a certain improvement over the conventional art, but due to both the buffer layer and the arc extinguishing layer have structural weakness and the composition and structure of the two is different, not only the operating procedures are complicated during the low temperature co-firing process, but also the gap between the buffer layer and the arc extinguishing layer will still cause uneven shrinkage of the insulating layer and/or the fuse element permeating into the gap during the low temperature co-firing process, which affects the fusing characteristic of the fuse element.

SUMMARY

An aspect relates to a fuse with a functional layer, which has a stable structure with arc extinguishing and buffering functions and can provide stable support for upper and lower layers.

The present disclosure provide a fuse comprising insulating layers and a fuse element, wherein the insulating layers comprise an upper insulating layer and a lower insulating layer, and the fuse element is arranged between the upper insulating layer and the lower insulating layer; the insulating layers are provided with terminal electrodes electrically connected with the fuse element, wherein the fuse further comprises a functional layer provided between the fuse element and one of the insulating layers; the functional layer comprises a substrate and an arc extinguishing material uniformly or substantially uniformly distributed in the substrate, wherein the arc extinguishing material comprises a sealed cavity, and the substrate comprises low temperature co-fired ceramic powder, aerosol silicon oxide, silicon oxide, inert resin, phosphoric acid and phosphate ester polyester, and content of the arc extinguishing material of the functional layer is 1-50 wt %.

The arc extinguishing material in the functional layer can generate voids under the pressure and temperature conditions when the fuse element is fused, specifically, as the interface of the glass body or ceramic body in the arc extinguishing material is melted and broken, and the cavities preset in the glass body or ceramic body absorb the heat and shock waves generated when the fuse element is fused, therefore absorb the generated metal vapor to quench the arc.

The arc extinguishing material of the functional layer will produce voids only after/when the fuse element is fused, and stable support among the components in the entire functional layer is provided during the production process, so that during the low temperature co-firing process of preparing the fuse, the functional layer can provide stable support for the fuse element layer and the insulating layers, and produce a dependent shrinkage at the contact part, which overcomes shrinkage mismatching of the fuse element with the buffer layer (the pressure relief spaces or cavities) and the arc extinguishing layer (arc layer) in the conventional art due to unsupporting during the sintering process, further to overcome disadvantages such as deformation, bending, and defects of the fuse element caused by such a shrinkage mismatching, and to ensure the flatness, consistency and integrity of the fuse element.

Further, the functional layer is located above and/or below the fuse element, and the functional layer is in contact with the fuse element. The fuse comprises a plurality of layers of fuse elements stacked in sequence, and the functional layer is arranged above and/or below each layer of fuse element.

Further, a single functional layer comprises a plurality of sub-functional layers separated from each other, the sub-functional layers are located in the same plane, and each of the sub-functional layers is in contact with a corresponding fuse element. Further, in the same plane, the number of the sub-functional layers is 3.

Further, the arc extinguishing material is any one of hollow glass microspheres, a glass body having a plurality of the sealed cavities, or a ceramic body having a plurality of the sealed cavities, wherein the glass body having a plurality of the sealed cavities is formed after low temperature co-firing of glass powder mixed with foaming agent, and the ceramics having a plurality of the sealed cavities is formed after low temperature co-firing of ceramic powder mixed with foaming agent.

Further, the arc extinguishing material is a mixed glass of one or more of boron oxide, silicon oxide and aluminum oxide.

Further, the sphere diameter D50 of the arc extinguishing material is 10-80 microns; the distribution of the sphere diameter could be 1-120 microns.

The present disclosure also provides a production method for a fuse, which comprises following steps:

S1, preparing glass-ceramic slurry with the low temperature co-fired ceramic powder and binder;

S2, adding aerosol silicon oxide, silicon oxide, inert resin, phosphoric acid and phosphate ester polyester to the glass-ceramic slurry, and fully stirring and grinding to prepare a pre-slurry of functional layer;

S3, preparing functional layer slurry by adding arc extinguishing material to the pre-slurry of functional layer, wherein the arc extinguishing material is any one of hollow glass microspheres, glass powder mixed with foaming agent, or ceramic powder mixed with foaming agent, and content of the arc extinguishing material of the functional layer is 1-50 wt %;

S4, coating a layer of the glass-ceramic slurry to form a slurry layer of glass-ceramic, which is a lower insulating layer slurry;

S5, coating at least one layer of fuse element layer slurry and at least one layer of functional layer slurry on the slurry layer of glass-ceramic, coating the functional layer slurry above and/or below each layer of fuse element layer slurry, and coating the slurry layer of glass-ceramic between two adjacent layers of fuse element layer slurry to form a green body of fuse in which a uppermost layer is an upper insulating layer slurry comprising the slurry layer of glass-ceramic;

S6, placing the green body of fuse in a glue discharging furnace to discharge rubber from the green body of fuse;

S7, sintering the green body of fuse;

S8, performing processes of chamfering, mounting terminal electrodes, sintering silver, and electroplating on the green body of fuse to form a fuse having a functional layer, the functional layer comprises hollow glass and/or hollow ceramic body.

Further, in Step S5, a single layer of functional layer slurry comprises a plurality of sublayers of functional layer slurry that are separated from each other and located in the same plane.

Further, a step of cutting the green body of fuse is provided after Step S5 and before Step S6.

Further, a solid content in the glass-ceramic slurry is 40-80 wt %.

Further, content of the glass-ceramic slurry in the pre-slurry of afunctional layer is 40-80 wt %.

Further, the total amount of aerosol silicon oxide and silicon oxide in the pre-slurry of functional layer is 0.1-20 wt %.

Further, content of the low temperature co-fired ceramic powder in the pre-slurry of functional layer is 0-20 wt %.

Further, a sintering temperature for sintering the green body of fuse is 600-1000° C., and a sintering time is 60-240 minutes.

The beneficial effects of the present disclosure are:

Compared with the conventional art, the present disclosure provides a fuse having the functional layer, the arc extinguishing material of the functional layer will produce voids only after/when the fuse element is fused, and stable support among the components in the entire functional layer is provided during the production process, so that during the low temperature co-firing process of preparing the fuse, the functional layer can provide stable support for the fuse element layer and the insulating layers, and produce a dependent shrinkage at the contact part, which overcomes shrinkage mismatching of the fuse element with the buffer layer (the pressure relief spaces or cavities) and the arc extinguishing layer (arc layer) in the conventional art due to unsupporting during the sintering process, further to overcome disadvantages such as deformation, bending, and defects of the fuse element caused by such a shrinkage mismatching, and to ensure the flatness, consistency and integrity of the fuse element.

Further, the functional layer of the present disclosure combines the advantages of pressure relief and arc extinguishing: the pressure and temperature produced when the fuse element is fused is sufficient to melt and break the interface of the glass body and/or hollow ceramic body in the arc extinguishing material, therefore the cavities preset in the glass body absorb the heat and shock waves generated when the fuse element is fused, and absorb the generated metal vapor to quench the arc. The shortcoming that small fuse cannot withstand high voltage, especially as a strong discharge arc phenomenon occurs when the circuit is short-circuited is overcome, which results in blow-ups, bursts, burning board and other abnormal phenomena that affects the safety performance of the circuit, therefore the voltage withstand capability of the existing fuses can be significantly improved; at the same time the energy density of the fuse products can be increased to ensure that it can be safely broken when the circuit is abnormally short-circuited.

This design scheme combines the pressure relief cavities and the arc extinguishing material into a single functional layer, and reduces the difficulty of cavity processing and the compactness shortcomings of the arc extinguishing layer, which can improve the product yield and reduce the cost.

Due to the use of wet molding and UV curing technology, this solution has low process difficulty: the functional layer can be arranged around the fuse element, and one or more functional layer structures can also be arranged around the fuse element to further improve the withstand voltage capacity and safe breaking capacity thereof.

In the functional layer designed in this scheme, the cavities are closed structures, which are not ordinary open cavities. Ceramic-glass powder can fill the gaps between the glass microspheres or between the cavities, so that the interface of the functional layer and the substrate after sintering can form a smooth and dense boundary, which provides the support for determining the interface for the co-firing of different materials, and brings no risk of the substrate material permeating into cavities during co-firing, therefore, there is not too much restriction on the process, and it can be applied to any co-fineable substrates and cooperate with any co-firing process.

BRIEF DESCRIPTION

Some of the embodiments will be described in detail, with references to the following Figures, wherein like designations denotes like members, wherein.

reference symbols as following: 1—fuse element; 2—insulating layer; 21—interlayer; 3—functional layer; 31—arc extinguishing material; 32—substrate; 4—terminal electrode.

In the following, the present disclosure is further illustrated combining with the accompanying drawings and specific embodiments.

DETAILED DESCRIPTION

The specific embodiments of the present disclosure given below can be used to further understand the present disclosure, but they are not a limitation of the present disclosure.

Embodiment 1

Figure 1:
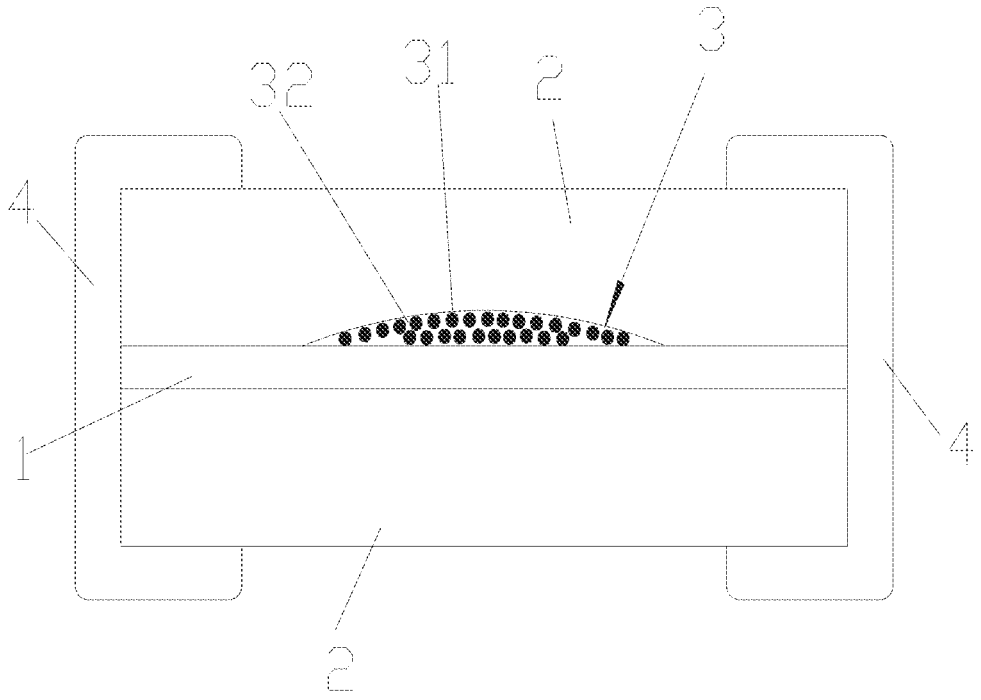
FIG. 1 is a schematic structure diagram of the fuse in Embodiment 1 of the present disclosure.

As shown in FIG. 1, the present disclosure provide a fuse comprising insulating layers 2 and a fuse element 1, the insulating layers comprise an upper insulating layer and a lower insulating layer, the fuse element 1 is arranged between the upper insulating layer and the lower insulating layer, the insulating layers 2 are provided with terminal electrodes 4 electrically connected with the fuse element 1 thereon, and the fuse further comprises a functional layer 3 provided between the fuse element 1 and one of the insulating layers 2, the functional layer 3 comprises a substrate 32 and an arc extinguishing material 31 uniformly or substantially uniformly distributed in the substrate 32, the arc extinguishing material 31 is a glass body and/or ceramic body having sealed cavities, and the substrate 32 comprises low temperature co-fired ceramic powder, aerosol silicon oxide, silicon oxide, inert resin, phosphoric acid and phosphate ester polyester, and the content of the arc extinguishing material 31 of the functional layer is 1-50 wt %.

The arc extinguishing material 31 in the functional layer 3 can generate voids under the pressure and temperature conditions when the fuse element is fused, specifically, the interface of the glass body or ceramic body in the arc extinguishing material is melted and broken, and the cavities preset in the glass body or ceramic body absorb the heat and shock waves generated when the fuse element is fused, and absorb the generated metal vapor to quench the arc. These sealed cavities wrapped in the glass body can be produced by prefabricated hollow glass microspheres, or heated gas-generating materials can be added to the glass body or ceramic body to form sealed cavities in the glass body or ceramic body during co-firing.

In this embodiment, the arc extinguishing material 31 is a mixed glass of one or more of boron oxide, silicon oxide and aluminum oxide. The distribution of sphere diameter of the arc extinguishing material is 1-120 microns; the sphere diameter D50 of the arc extinguishing material is 10-80 microns.

The production method for a fuse in this embodiment, comprises following steps:

S1, glass-ceramic slurry was prepared by low temperature co-fired ceramic powder and binder, wherein the solid content in the glass-ceramic slurry was controlled to be 40-80 wt %, and the viscosity was 2.2 kcps after sufficient stirring;

S2, aerosol silicon oxide, silicon oxide, inert resin, phosphoric acid and phosphate ester polyester were added to the glass-ceramic slurry, and fully stirred and grinded to prepare a pre-slurry of functional layer; the total amount of aerosol silicon oxide and silicon oxide was 0.1-20 wt %.

S3, an arc extinguishing material was added to the pre-slurry of functional layer and fully stirred and grinded to prepare a functional layer slurry with arc extinguishing and press relief functions, wherein the arc extinguishing material was any one of hollow glass microspheres, glass powder mixed with foaming agent, or ceramic powder mixed with foaming agent, and the content of the arc extinguishing material of the functional layer was 1-50 wt %;

S4, a layer of the glass ceramic slurry was coated to form a slurry layer of glass-ceramic to form a lower insulating layer slurry;

S5, a layer of fuse element layer slurry having a layer of UV-curable binder was printed above the slurry layer of glass-ceramic using screen printing, wherein a silver content of the fuse element layer slurry was between 55-85%, and a layer of functional layer slurry layer was printed above the fuse element layer slurry through a steel screen, and a layer of slurry layer of glass-ceramic was coated above the functional layer slurry layer to form a green body of fuse in which an uppermost layer was an upper insulating layer slurry comprising the slurry layer of glass-ceramic;

the green body of fuse was cut;

S6, the green body of fuse was placed in a glue discharging glue discharging furnace to discharge the glue, wherein the temperature for glue discharging was 300-450° C., and the time for glue discharging was 1-40 hours;

S7, the green body of fuse was sintered, wherein the temperature for sintering was 600-1000° C., and the time for sintering was 30-240 minutes;

S8, chamfering, mounting terminal electrodes, sintering silver, and electroplating processes were performed on the green body of fuse to form a fuse having a functional layer, the functional layer comprised hollow glass and/or hollow ceramic body.

Embodiment 2

Figure 2:
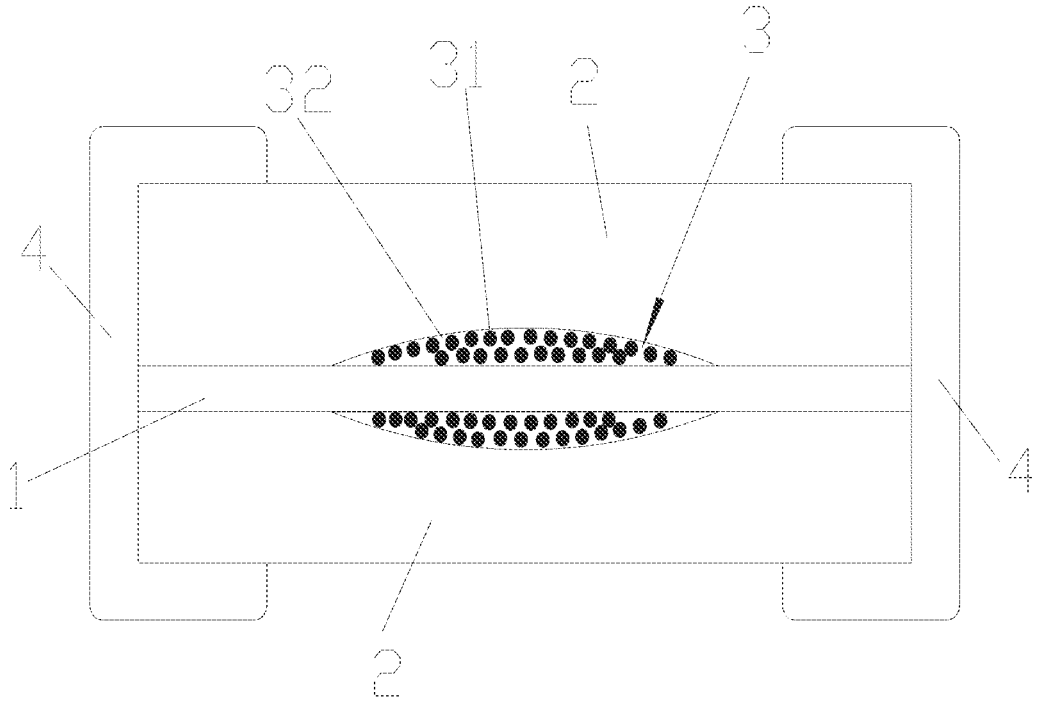
FIG. 2 is a schematic structure diagram of the fuse in Embodiment 2 of the present disclosure.

As shown in FIG. 2, this embodiment provides a fuse, differing from Embodiment 1 in that the functional layer 3 in the fuse comprises two functional layers 3 arranged above the fuse element 1 and below the fuse element 1, and the functional layer 3 is in contact with the corresponding fuse element 1. The production method for the corresponding fuse is different from the production method of Embodiment 1 in step S5, which is specifically as follows:

S5, a layer of functional layer slurry layer was printed above the slurry layer of glass-ceramic through steel screen printing, and a layer of fuse element layer slurry having a layer of UV-curable binder was printed above the functional slurry layer using screen printing, wherein the silver content of the fuse element layer slurry was between 55-85%, and a layer of functional layer slurry layer was printed above the fuse element layer slurry through steel screen printing, and a layer of slurry layer of glass-ceramic was coated above the functional layer slurry layer to form a green body of fuse in which an uppermost layer was an upper insulating layer slurry comprising the slurry layer of glass-ceramic.

Embodiment 3

Figure 3:
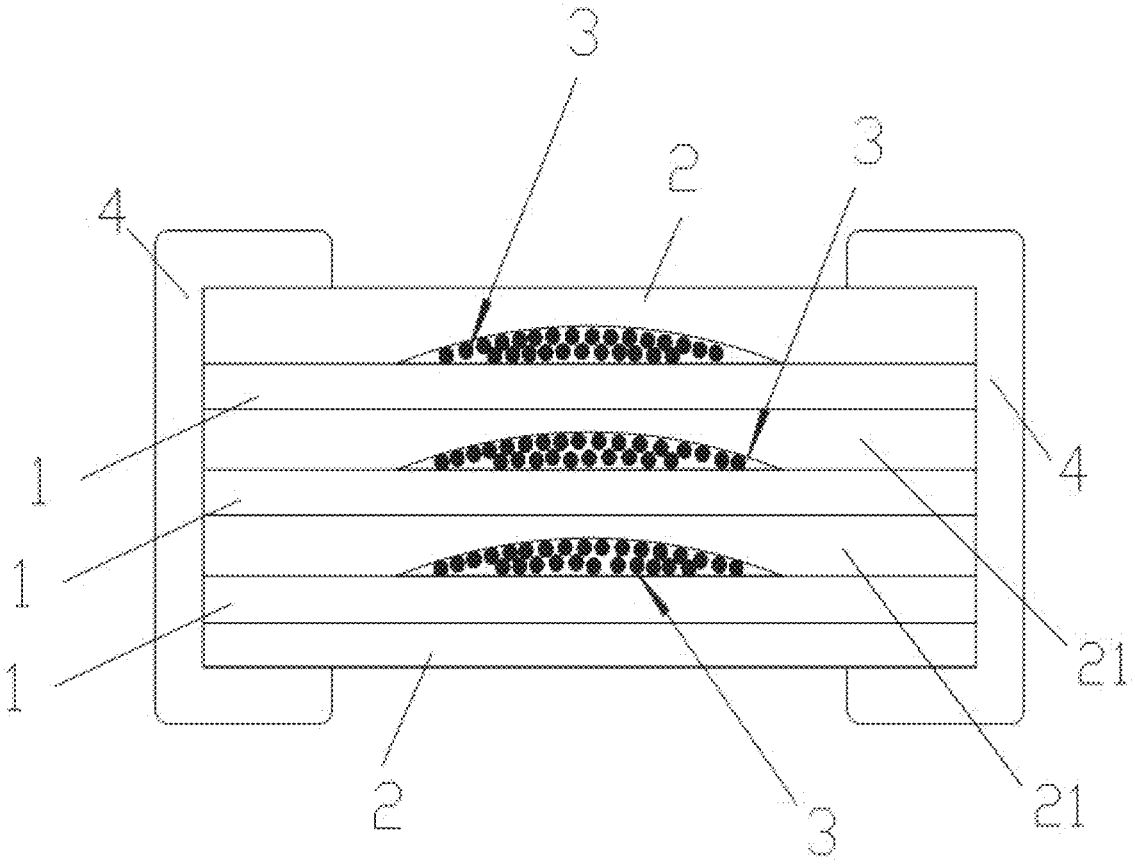
FIG. 3 is a schematic structure diagram of the fuse in Embodiment 3 of the present disclosure.
Figure 4:
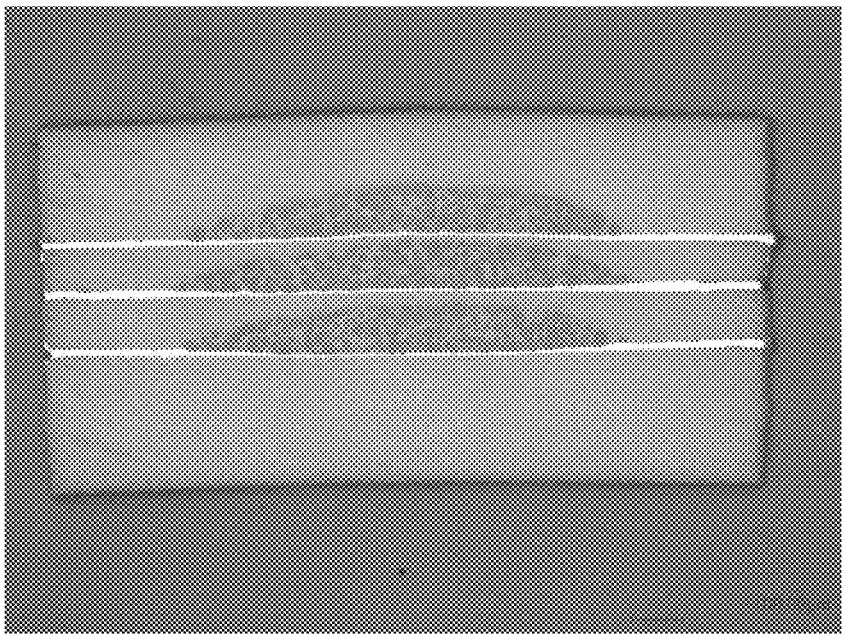
FIG. 4 is a schematic diagram of a cross-sectional photograph of the internal structure of the fuse in Embodiment 3 of the present disclosure.

As shown in FIGS. 3-4, this embodiment provides a fuse, differing from Embodiment 1 in that the fuse element 1 comprises three layers of fuse elements 1 in sequence, a functional layer 3 is provided above each layer of fuse element 1, and the functional layer 3 is in contact with the corresponding fuse element 1, and adjacent fuse elements 1 are separated by insulating materials, namely interlayer 21.

The production method for a fuse in this embodiment, comprises following steps:

S1, glass-ceramic slurry was prepared by low temperature co-fired ceramic powder and binder, wherein the solid content in the glass-ceramic slurry was controlled to be 71.43 wt %, and the viscosity was 2.2 kcps after sufficient stirring;

S2, aerosol silicon oxide, silicon oxide, inert resin, phosphoric acid and phosphate ester polyester were added to the glass-ceramic slurry, and fully stirred and grinded to prepare a pre-slurry of functional layer; the total amount of aerosol silicon oxide and silicon oxide was 9.32 wt %, D50=0.8 micron and the proportion of low temperature co-fired ceramic powder was 2.6 wt %.

S3, an arc extinguishing material was added to the pre-slurry of functional layer and fully stirred and grinded to prepare a functional layer slurry with a viscosity of 39.5 kcps and arc extinguishing and press relief functions, wherein the arc extinguishing material was any one of hollow glass microspheres, glass powder mixed with foaming agent, or ceramic powder mixed with foaming agent, and the content of the arc extinguishing material was 14.9 wt %;

S4, a layer of the glass ceramic slurry was coated to form a slurry layer of glass-ceramic to form a lower insulating layer slurry;

S5, a layer of fuse element layer slurry having a layer of UV-curable binder was printed above the slurry layer of glass-ceramic using screen printing, wherein a silver content of the fuse element layer slurry was between 55-85%, and a layer of functional layer slurry layer was printed above the fuse element layer slurry through steel screen printing, a layer of slurry layer of glass-ceramic was coated above the functional layer slurry layer, and repeated three times to prepare a three-layer electrode structure, to form a green body of fuse in which an uppermost layer was an upper insulating layer slurry comprising the slurry layer of glass-ceramic;

the green body of fuse was cut;

S6, the green body of fuse was placed in a glue discharging furnace to discharge the glue, wherein the temperature for glue discharging was 360° C., and the time for glue discharging was 36 hours;

S7, the green body of fuse was sintered, wherein the temperature for sintering was 850-900° C., and the time for sintering was 30 minutes;

S8, chamfering, mounting terminal electrodes, sintering silver, and electroplating processes were performed on the green body of fuse to form a fuse having a functional layer, and the fuse was a 5-ampere fuse (Size: 0603).

Figure 5:
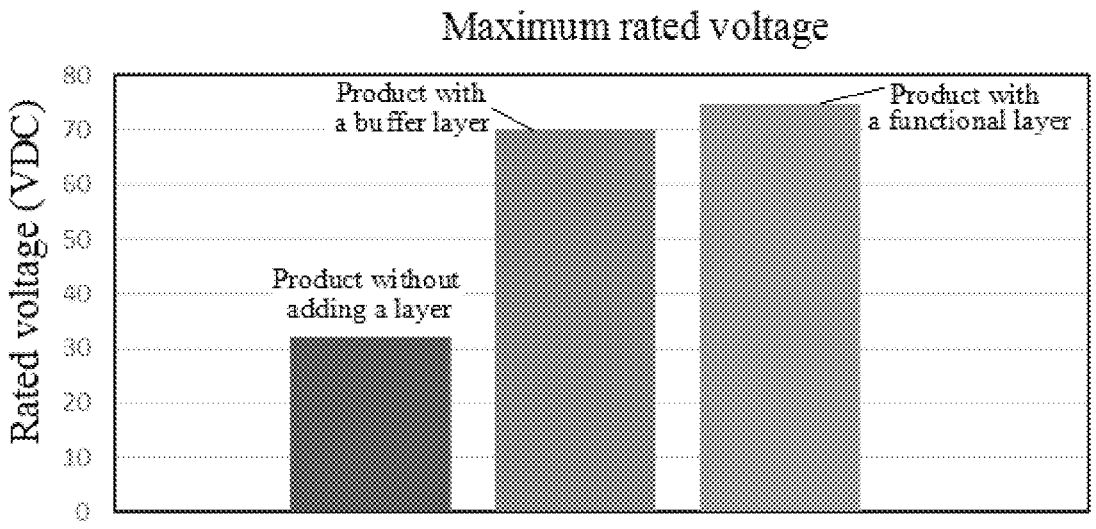
FIG. 5 is a bar graph comparing the maximum rated voltage of the fuse in Embodiment 3 of the present disclosure with other products.
Figure 6:
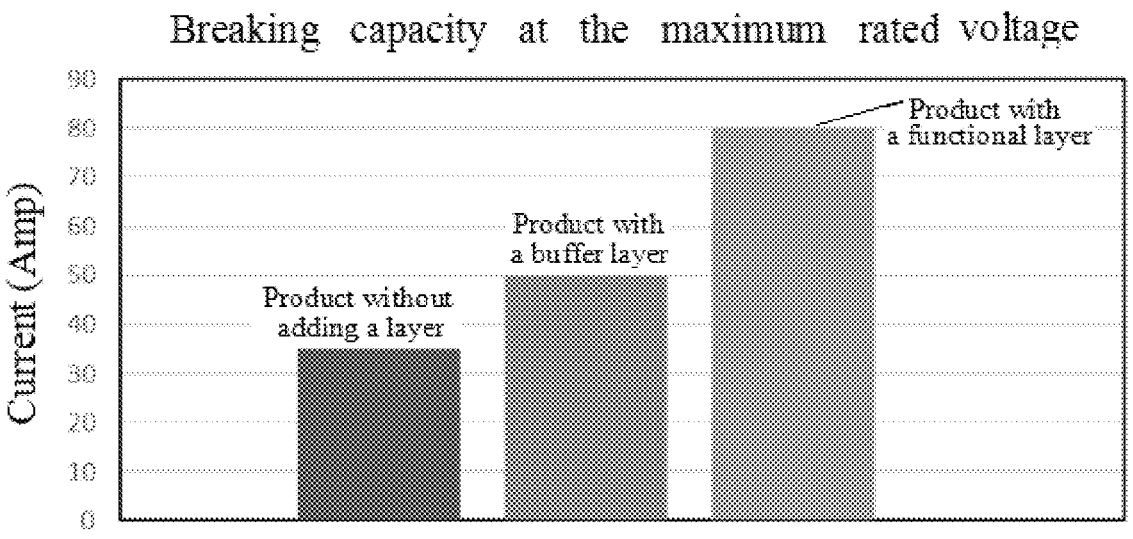
FIG. 6 is a bar graph comparing the breaking capacity of the fuse in Embodiment 3 of the present disclosure with other products at the maximum rated voltage.

The experimental results shown in FIGS. 5-6 and Table 1 show that by adding the function layer with the arc extinguishing and pressure relief functions of the present disclosure, its breaking capacity is increased from 35 A/32 VDC to 80 A/75 VDC compared with products without this functional layer. At the same time, it has better breaking capacity than the product with a buffer layer (the invention patent CN106206201 of our company). Table 1 shows the experimental comparison results of products with or without this functional layer.

TABLE 1

| Size: 0603 | Rated Current (A) | Maximum rated voltage (VDC) | Breaking capacity (A) |
|---|---|---|---|
| Product with a functional layer | 5 | 75 | 80 A/75 VDC |
| Product without adding a layer | 5 | 32 | 35 A/32 VDC |
| Product with a buffer layer | 5 | 70 | 50 A/70 VDC |

Embodiment 4

Figure 7:
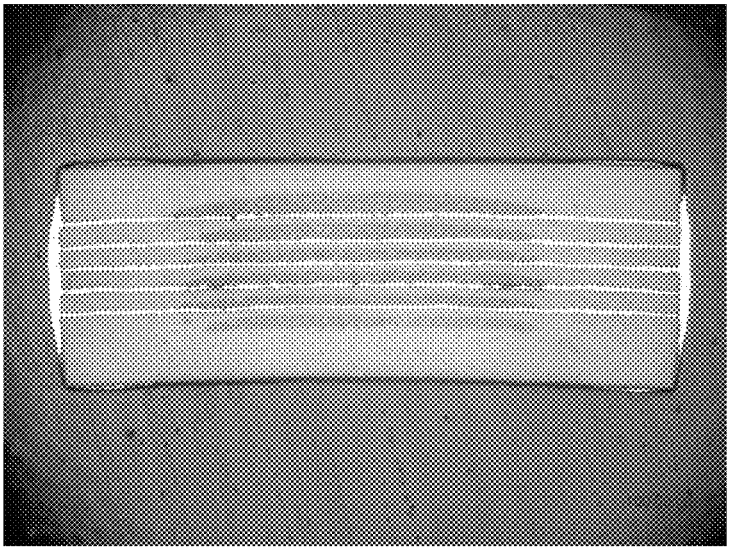
FIG. 7 is a schematic diagram of a cross-sectional photograph of the internal structure of the fuse in Embodiment 4 of the present disclosure.

As shown in FIG. 7, this embodiment provides a fuse, differing from Embodiment 1 in that the fuse element 1 comprises five layers of fuse elements 1 in sequence, a functional layer 3 is provided above each layer of fuse element 1, and the functional layer 3 is in contact with the corresponding fuse element 1, and adjacent fuse elements 1 are separated by insulating materials, namely interlayer.

The production method for a fuse in this embodiment, comprises following steps:

S1, glass-ceramic slurry was prepared by low temperature co-fired ceramic powder and binder, wherein the solid content in the glass-ceramic slurry was controlled to be 71.43 wt %, and the viscosity was 2.2 kcps after sufficient stirring;

S2, aerosol silicon oxide, silicon oxide, inert resin, phosphoric acid and phosphate ester polyester were added to the glass ceramic slurry, and fully stirred and grinded to prepare a pre-slurry of functional layer; the total amount of aerosol silicon oxide and silicon oxide was 9.15 wt %, D50=0.8 micron and the proportion of low temperature co-fired ceramic powder was 2.3 wt %.

S3, an arc extinguishing material was added to the pre-slurry of functional layer and fully stirred and grinded to prepare a functional layer slurry with a viscosity of 30 kcps and arc extinguishing and press relief functions, wherein the arc extinguishing material was any one of hollow glass microspheres, glass powder mixed with foaming agent, or ceramic powder mixed with foaming agent, and the content of the arc extinguishing material was 14.5 wt %;

S4, a layer of the glass ceramic slurry was coated to form a slurry layer of glass-ceramic to form a lower insulating layer slurry;

S5, a layer of fuse element layer slurry having a layer of UV-curable binder was printed above the slurry layer of glass-ceramic using screen printing, wherein a silver content of the fuse element layer slurry was between 55-85%, and a layer of functional layer slurry layer was printed above the fuse element layer slurry through steel screen printing, a layer of slurry layer of glass-ceramic was coated above the functional layer slurry layer, and repeated five times to prepare a five-layer electrode structure, to form a green body of fuse in which an uppermost layer was an upper insulating layer slurry comprising the slurry layer of glass-ceramic;

the green body of fuse was cut;

S6, the green body of fuse was placed in a glue discharging furnace to discharge the glue, wherein the temperature for glue discharging was 340° C., and the time for glue discharging was 34 hours;

S7, the green body of fuse was sintered, wherein the temperature for the sintering was 910° C., and the time for sintering was 30 minutes;

S8, chamfering, mounting terminal electrodes, sintering silver, and electroplating processes were performed on the green body of fuse to form a fuse having a functional layer, and the fuse was a 20-ampere fuse (Size 1206).

Figure 8:
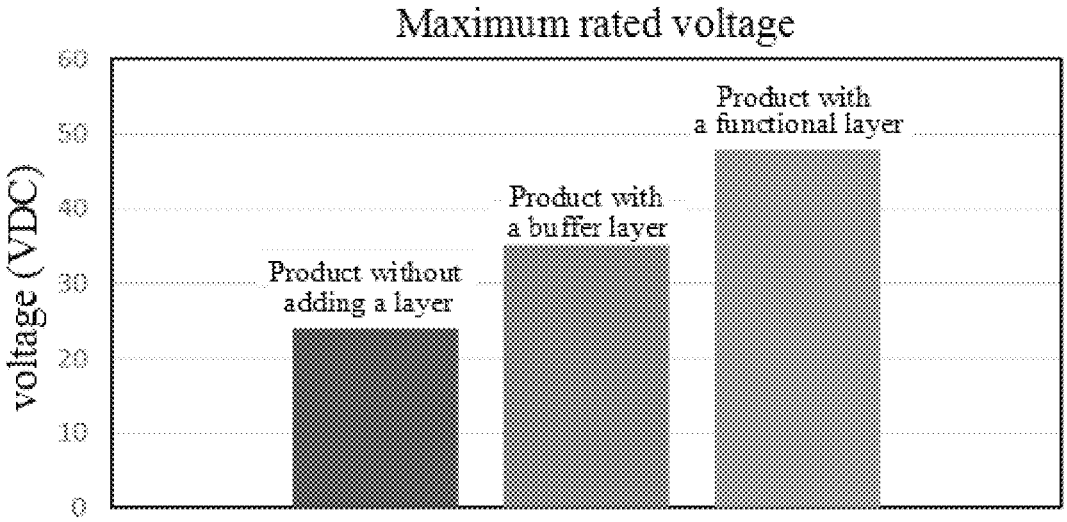
FIG. 8 is a bar graph comparing the maximum rated voltage of the fuse in Embodiment 4 of the present disclosure with other products.
Figure 9:
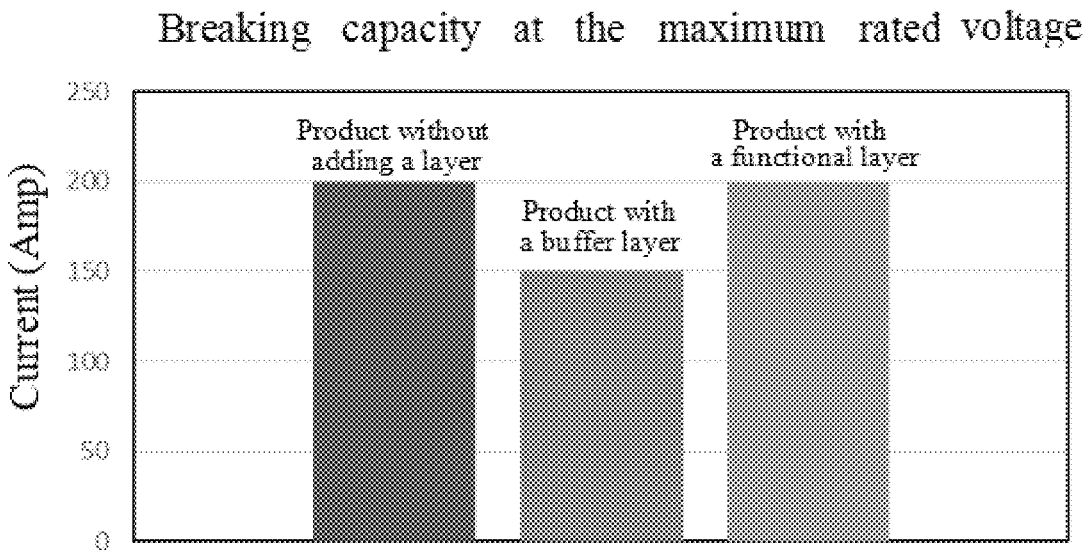
FIG. 9 is a bar graph comparing the breaking capacity of the fuse in Embodiment 4 of the present disclosure with other products at the maximum rated voltage.

The experimental results shown in Table 2 and FIGS. 8-9 show that by adding the function layer with the arc extinguishing and pressure relief functions of the present disclosure, its breaking capacity is increased from 200 A/24 VDC to 200 A/48 VDC. Table 2 shows the experimental comparison results of products with or without this functional layer.

TABLE 2

| Size: 1206 | Rated Current (A) | Maximum rated voltage (VDC) | Breaking capacity (A) |
|---|---|---|---|
| Product with a functional layer | 20 | 48 | 200 A/48 VDC |
| Product without adding a layer | 20 | 24 | 200 A/24 VDC |
| Product with a buffer layer | 20 | 35 | 150 A/35 VDC |

Embodiment 5

Figure 10:
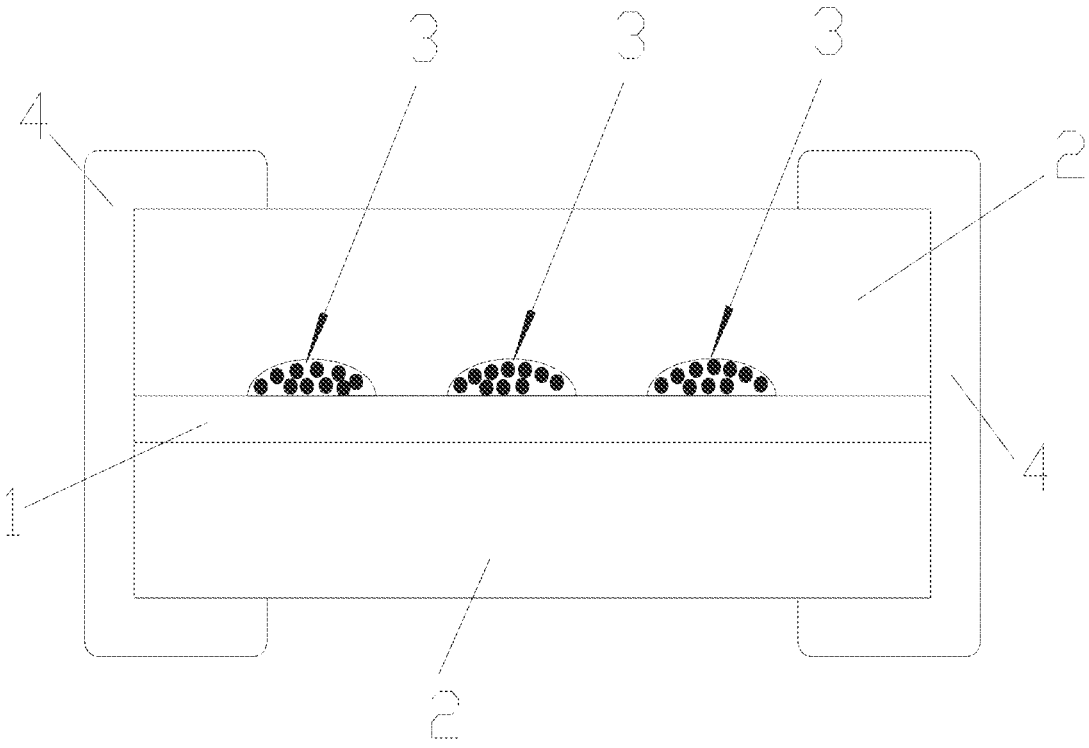
FIG. 10 is a schematic structure diagram of the fuse in Embodiment 5 of the present disclosure.

As shown in FIG. 10, this embodiment provides a fuse, differing from Embodiment 1 in that the functional layer 3 in the fuse comprises three sub-functional layers separated from each other in the same plane, the composition of each sub-functional layer is the same as that of the functional layer 3, and each sub-functional layer is in contact with the corresponding fuse element 1. The production method for the corresponding fuse is different from the production method of Embodiment 1 in step S5, which is specifically as follows:

S5, a layer of fuse element layer slurry having a layer of UV-curable binder was printed above the slurry layer of glass-ceramic using screen printing, wherein a silver content of the fuse element layer slurry was between 55-85%, and a layer of functional layer slurry layer having a plurality of sub-functional layer slurry layers was printed above the fuse element layer slurry through steel screen printing, the plurality of sub-functional layer slurry layers separated from each other was in the same plane, and a layer of slurry layer of glass-ceramic was coated above the functional layer slurry layer to form a green body of fuse in which an uppermost layer was an upper insulating layer slurry comprising the slurry layer of glass-ceramic.

The arc extinguishing material 31 of the functional layer 3 will produce voids only after/when the fuse element 1 is fused, and stable support among the components in the entire functional layer is provided during the production process, so that during the low temperature co-firing process of preparing the fuse, the functional layer can provide stable support for the fuse element layer and the insulating layers, and produce a dependent shrinkage at the contact part, which overcomes shrinkage mismatching of the fuse element with the buffer layer (the pressure relief spaces or cavities) and the arc extinguishing layer (arc layer) in the conventional art due to unsupporting during the sintering process, further to overcome disadvantages such as deformation, bending, and defects of the fuse element caused by such a shrinkage mismatching, and to ensure the flatness, consistency and integrity of the fuse element.

The embodiments described above are only preferable embodiments, should not be concluded to limit the scope of rights of this disclosure, any equivalent variations according to the claims of the present disclosure should be covered by the scope of the present disclosure.

For the sake of clarity, it is to be understood that the use of 'a' or 'an' throughout this application does not exclude a plurality, and 'comprising' does not exclude other steps or elements.

What is claimed is:

1. A fuse, comprising insulating layers and a fuse element, wherein the insulating layers comprise an upper insulating layer and a lower insulating layer, and the fuse element is arranged between the upper insulating layer and the lower insulating layer; the insulating layers are provided with terminal electrodes electrically connected with the fuse element, wherein the fuse further comprises a functional layer provided between the fuse element and one of the insulating layers; the functional layer comprises substrate and arc extinguishing material uniformly or substantially uniformly distributed in the substrate, wherein the arc extinguishing material comprises a sealed cavity, and wherein the substrate comprises low temperature co-fired ceramic powder, aerosol silicon oxide, silicon oxide, inert resin, phosphoric acid and phosphate ester polyester.

2. The fuse according to claim 1, wherein the insulating layers further comprise an interlayer, and the fuse comprises a plurality of the fuse elements and a plurality of the functional layers, and the functional layer is arranged above and/or below each of the fuse element, and the interlayer is arranged between adjacent two of the fuse elements.

3. The fuse according to claim 1, wherein the arc extinguishing material is hollow glass microsphere, glass body with a plurality of the sealed cavities, or ceramic body with a plurality of the sealed cavities.

4. The fuse according to claim 1, wherein the sphere diameter D50 of the arc extinguishing material is 10-80 microns.

5. A production method for the fuse according to claim 1, comprising the following steps:

S1, preparing glass-ceramic slurry with low temperature co-fired ceramic powder and binder;

S2, adding aerosol silicon oxide, silicon oxide, inert resin, phosphoric acid and phosphate ester polyester to the glass-ceramic slurry, and fully stirring and grinding to prepare a pre-slurry of functional layer;

S3, preparing functional layer slurry by adding arc extinguishing material to the pre-slurry of functional layer, wherein the arc extinguishing material is any one of hollow glass microspheres, glass powder mixed with foaming agent, or ceramic powder mixed with foaming agent;

S4, coating a layer of the glass-ceramic slurry to form a slurry layer of glass-ceramic, which is a lower insulating layer slurry;

S5, coating at least one layer of fuse element layer slurry, at least one layer of functional layer slurry and a layer of the glass-ceramic slurry on the lower insulating layer slurry, coating the functional layer slurry above and/or below the fuse element layer slurry, and coating the layer of the glass-ceramic slurry to be an uppermost layer as an upper insulating layer slurry, to form a green body of the fuse;

S6, placing the green body of the fuse in a glue discharging furnace to discharge rubber from the green body of the fuse;

S7, sintering the green body of the fuse;

S8, performing processes of chamfering, mounting terminal electrodes, sintering silver, and electroplating on the green body of the fuse.

6. The production method according to claim 5, wherein, in Step S5, the at least one layer of functional layer slurry comprises a plurality of sublayers of functional layer slurry that are separated from each other and located in the same plane.

7. The production method according to claim 5, further comprising a step of cutting the green body of the fuse after Step S5 and before Step S6.

8. The production method according to claim 6, further comprising a step of cutting the green body of the fuse after Step S5 and before Step S6.

9. The production method according to claim 5, wherein a solid content in the glass-ceramic slurry is 40-80 wt %.

10. The production method according to claim 6, wherein a solid content in the glass-ceramic slurry is 40-80 wt %.

11. The production method according to claim 5, wherein content of the glass-ceramic slurry in the pre-slurry of functional layer is 40-80 wt %.

12. The production method according to claim 6, wherein content of the glass-ceramic slurry in the pre-slurry of functional layer is 40-80 wt %.

13. The production method according to claim 11, wherein the total amount of aerosol silicon oxide and silicon oxide in the pre-slurry of functional layer is 0.1-20 wt %.

14. The production method according to claim 11, wherein content of the low temperature co-fired ceramic powder in the pre-slurry of functional layer is 0-20 wt %.

15. The fuse according to claim 1, wherein two of the functional layers are arranged above and below the fuse element, respectively.

16. The fuse according to claim 1, wherein the functional layer comprises a plurality of sub-functional layers separated from each other in a same plane.

17. The fuse according to claim 1, wherein content of the arc extinguishing material of the functional layer is 1-50 wt %.

18. The production method according to claim 5, comprising, in Step S5, coating a plurality of layers of the functional layer slurry, and coating the slurry layer of glass-ceramic between two adjacent layers of the fuse element layer slurry.

19. The production method according to claim 5, wherein content of the arc extinguishing material in Step S3 is 1-50 wt %.

* * * * *